US008266990B1

(12) United States Patent
Janson

(10) Patent No.: US 8,266,990 B1
(45) Date of Patent: Sep. 18, 2012

(54) PUSH BUTTON MULTI-POSITION LOCKING PLIERS

(76) Inventor: Paul M. Janson, Northridge, CA (US)

( * ) Notice: Subject to any disclaimer, the term of this patent is extended or adjusted under 35 U.S.C. 154(b) by 291 days.

(21) Appl. No.: 12/795,517

(22) Filed: Jun. 7, 2010

Related U.S. Application Data

(63) Continuation-in-part of application No. 11/820,204, filed on Jun. 18, 2007, now Pat. No. 7,730,810.

(60) Provisional application No. 60/814,946, filed on Jun. 19, 2006.

(51) Int. Cl.
*B25B 7/12* (2006.01)
*B25B 7/04* (2006.01)

(52) U.S. Cl. ..... 81/367; 81/405; 81/409.5

(58) Field of Classification Search ..... 81/356, 81/363, 367–383, 386, 391, 392, 394, 405–409.5, 81/411–413, 416, 417, 427
See application file for complete search history.

(56) References Cited

U.S. PATENT DOCUMENTS 4,296,655 A * 10/1981 Tesoro ..... 81/405
4,773,288 A * 9/1988 Jang et al. ..... 81/409.5

* cited by examiner

*Primary Examiner* — David B Thomas
(74) *Attorney, Agent, or Firm* — Timothy Thut Tyson; Ted Masters; Freilich, Hornbaker & Rosen

(57) ABSTRACT

A push button locking pliers has a plurality of macro jaw width stations for grasping a wide variety of objects. A positioning mechanism is connected to a movable jaw member having a pivot that cooperates with a jaw adjustment slot in the main handle. The positioning mechanism is released by pushing on a push button on the pivot against a spring allowing the movable jaw member to move along the slot. The user places the positioning mechanism at the jaw positioning station that creates a macro spacing between the fixed and movable jaws that best fits the object to be grasped. The push button is then released allowing the pivot to engage the rounded hole of the new positioning station. The pivot is made self centering on the rounded hole of the new positioning station by having a frustoconical section that engages the side of the hole even if the pivot is not centered on the hole. The bias of the spring forces the frustoconical section along the side of the hole which pushes the pivot to a central position in the rounded hole making the pliers ready for use.

4 Claims, 11 Drawing Sheets

266
270
286
284
286
284
242
274

222
266
274
264
242

PUSH BUTTON MULTI-POSITION LOCKING PLIERS

CROSS REFERENCE TO RELATED APPLICATIONS

This application is a Continuation-in-Part of and claims the filing priority of application Ser. No. 11/820,204, filed Jun. 18, 2007, under 35 U.S.C. §120, now U.S. Pat. No. 7,730,810, issued Jun. 8, 2010, which claims the filing priority under 35 U.S.C. §119(e) of U.S. Provisional Application No. 60/814,946, filed Jun. 19, 2006, all of which claimed applications are included herein by reference.

TECHNICAL FIELD

The present invention relates generally to the field of hand tools, and more particularly to locking pliers having jaws that are selectively spaced apart in one of a plurality of positions to accommodate objects of various sizes prior to engaging the locking mechanism.

BACKGROUND OF THE INVENTION

Locking pliers are well known in the art. These devices have two jaws that may be locked on an object. The over-center locking mechanism is achieved by two handles, a fixed jaw on one of the handles, a movable jaw, a pivoting link between the handles, and an over-center spring between the movable jaw and the fixed jaw handle that together cooperate to lock the jaws on a work piece when the handles are forced together. The over-center mechanism includes a micro adjustment screw that controls the opening of the jaws over a limited range to accommodate articles of different sizes within the range and permits the over-center mechanism to lock. An example of such locking pliers is shown in U.S. Pat. No. 4,730,524 to Petersen that also includes a summary of the many Petersen Vise-Grip patents.

In addition to the micro adjustment screw for setting up the jaw spacing, some locking pliers include macro jaw opening mechanisms to allow use on a much wider range of work pieces. For example, U.S. Pat. No. 2,399,454 to Snell locates the jaw pivot in a slot in the upper jaw handle that is perpendicular to the upper jaw. The jaw pivot is adjusted along the slot by a screw with a head above the upper jaw handle. Turning the screw one way places the jaws closer together. Turning the screw the other way places the jaws further apart. Because of the fine spacing between the jaws that is possible using the screw, no separate micro adjustment screw in the handle is needed to set up the over-center locking mechanism as is found in the Peterson Vise-Grips.

U.S. Pat. Nos. 2,905,038 and 3,241,410 both to Paden have a long shank on the lower jaw holder. The lower jaw can be slid along the shank to determine the spacing between the jaws. The side of the shank has a series of teeth for holding the jaw. A pawl on the lower jaw engages any one of the teeth on the shank to hold the lower jaw in a given position relative to the upper jaw. Twenty-three positions are available on the embodiment shown in U.S. Pat. No. 2,905,038. Twenty positions are available on the embodiment shown in U.S. Pat. No. 3,241,410.

U.S. Pat. No. 3,672,245 to Hoffman is similar to Snell in that it has a slot perpendicular to the upper jaw in the upper jaw handle for holding the jaw pivot. But instead of using a screw to determine the location of the pivot in the slot, the position is determine by arcuate channels adjacent the slot for holding the lower jaw pivot at a desired spacing from the fixed upper jaw. Movement between the arcuate channels is achieved by loosening a nut on the pivot until the movable jaw can be slipped over the arcuate channels to a different set of arcuate channels. The nut is then tightened on the pivot to hold the pivot at a selected set of arcuate channels. Seven positions are available on the embodiment shown.

U.S. Pat. No. 3,981,209 to Caroff shows a locking pliers where the length of the link between the two handles is adjustable to control both the micro and macro jaw adjustment functions. Again a slot perpendicular to the upper jaw as in Hoffman and Snell is provided in the upper jaw handle. The length of the link is first adjusted to allow the pivot for the movable jaw to be moved in the slot toward or away from the fixed jaw. When the desired position is reached, the pivot is pushed into one of a plurality of teeth on the side of the slot opposite the link. The jaws are then moved around the work piece and the length of the link is further adjusted until the micro jaw adjustment is achieved that causes the jaws to lock on the work piece using the over-center principle when the handles are squeezed together. Five positions are available on the embodiment shown.

U.S. Pat. Nos. 6,578,452 and 5,022,290 both to Duffy have an upper jaw on a slide that moves in a slot in the lower jaw holder. The edge of the slide has a plurality of teeth for holding the jaw. A lock engages any one of the teeth to hold the upper jaw in a desired position with respect to the lower jaw. Three positions are available on the embodiment shown in U.S. Pat. No. 5,022,290. Thirty positions are available on the embodiment shown in U.S. Pat. No. 6,578,452.

U.S. Pat. No. 5,385,072 to Neff also has a slot in the holder for the lower jaw but moves the lower jaw in the slot instead of the upper jaw as in Duffy. Pins through the slot hold the lower jaw. The position of the lower jaw relative to the upper jaw is determined by an adjusting lever. About twelve positions are available on the embodiment shown.

Jaw adjustment mechanisms are also known in non-locking pliers. For example, U.S. Pat. No. 4,581,960 to Putsch shows a pliers having two handles that cross each other and are connected together by a pivot. The pivot is attached to one of the handles and slides in a slot in the other handle to change the gap between the jaws. The sides of the slot have teeth. The pivot is mounted in a rectangular block having teeth on the sides matching the teeth on the sides of the slot. A push button on the end of the pivot is pushed to move the rectangular block out of the slot. This allows the pivot to be moved along the slot to a new position. When the push button is released, a spring on the other end of the pivot forces the rectangular block back into the slot where the teeth once again engage each other locking the pivot at a desired location. About twelve positions are available on the embodiment shown.

BRIEF SUMMARY OF THE INVENTION

The present invention is directed to a push button locking pliers having a plurality of macro jaw width stations for grasping a wide variety of objects. A positioning mechanism is connected to a movable jaw member and cooperates with a jaw adjustment slot in the main handle. The positioning mechanism is released by pushing on a push button allowing it to move along the slot. The user places the positioning mechanism at the jaw positioning station that creates a macro spacing between the fixed and movable jaws that best fits the object to be grasped. An adjustment screw adjusts the micro spacing between the jaws to allow the pliers to lock on the object using an over-center mechanism when the handles are squeezed.

In accordance with a preferred embodiment, the main handle has a fixed jaw, an adjustment slot with a plurality of jaw positioning stations, and a distal end spaced from the fixed jaw with an adjustment screw. A locking handle having a jaw end and a distal end is under the main handle. A movable jaw member is pivotally coupled to the jaw end of the locking handle and has a movable jaw and the positioning mechanism. The positioning mechanism includes a pivot with an engaged position and a disengaged position, a pivot spring for biasing the pivot in the engaged position, and a push button for pushing the pivot out of the engaged position against the bias of the pivot spring. The pivot is positioned in the adjustment slot and pivotally connects the main handle to the movable jaw member. The pivot is movable by pressing the push button to disengage the pivot. After it is moved to one of the other jaw positioning stations, it is engaged in the new stations by releasing the push button.

In a feature of the embodiment, three jaw positioning stations are provided along the slot. The user initially selects one of the three stations to best position the pliers on an object.

In accordance with a preferred embodiment, each jaw positioning station includes a rounded hole. The pivot has a longitudinal axis with a rounded shoulder substantially matching the rounded hole, a reduced portion less than the size of the rounded hole, and a push button on the end that is biased away from the rounded hole by the pivot spring. The pivot spring biases the pivot along the longitudinal axis. The rounded shoulder is positioned in the rounded hole by the pivot spring when the push button is not pushed thereby causing the movable jaw member to pivot on the main handle at the jaw positioning station. When the pivot is pushed along its longitudinal axis by the push button, the reduced portion is positioned in the rounded hole allowing the pivot to be moved between positioning stations.

In accordance with an alternative embodiment of the invention, the pivot is modified to have two rounded shoulders substantially matching the rounded hole, two substantially parallel flats along the longitudinal axis between the two rounded shoulders, and the pivot spring biases the pivot rotationally about the longitudinal axis. When the push button is not pushed, the two rounded shoulders are positioned in the rounded hole by the pivot spring thereby pivoting the movable jaw member on the main handle at the jaw positioning station. When the push button is pushed, the two parallel flats are positioned in the rounded hole thereby allowing the pivot to be moved between positioning stations.

In other alternative embodiments, a plurality of teeth are provided along the sides of the slot or the face of the handle to provide the macro jaw spacing adjustment.

In accordance with another embodiment, the plurality of jaw positioning stations includes a most closed jaw positioning station and an opposite most open jaw positioning station. The jaws may be moved to the most closed position by pushing the push button to release the pivot and allowing the over-center spring to pull the positioning mechanism to the most closed jaw positioning station.

In accordance with another embodiment, the process of moving the positioning mechanism to the most closed jaw positioning station may be enhanced by manually pressing the fixed jaw and movable jaw together after the push button has been pressed.

In accordance with another embodiment, the jaws may be moved to the most open position by pushing the push button to release the pivot and pressing the distal ends of the main and locking handles together pivoting the fixed and movable jaws apart around where the link member engages the adjustment screw.

In accordance with another embodiment, the pivot is self centering and includes a frustoconical section which is shaped and dimensioned to engage the rounded hole of the jaw positioning station even when the pivot is not centered on the hole. When the pivot is moved from a disengaged position to a new station, the frustoconical section engages the new hole and pushes the pivot to a central position within the jaw positioning station ready for use.

In accordance with another embodiment, the pivot includes a second frustoconical section spaced apart from the frustoconical section.

In accordance with another embodiment, the frustoconical section engages the rounded hole of the jaw positioning station disposed on the first side of the main handle, and the second frustoconical section simultaneously engages the rounded hole of the jaw positioning station disposed on the second side of the main handle.

In accordance with another embodiment, the over-center spring of the over center mechanism is positioned between the main handle and the movable jaw member at an angle of substantially 60° to the longitudinal axis of the slot to facilitate movement of the movable jaw member up the adjustment slot.

Other possible embodiments, in addition to the possible embodiments enumerated above, will become apparent from the following detailed description, taken in conjunction with the accompanying drawings, which illustrate, by way of example, the principles of the locking pliers.

BRIEF DESCRIPTION OF THE DRAWINGS

FIG. 16 is an enlarged cross sectional view showing the second embodiment pivot in a disengaged position;

DETAILED DESCRIPTION OF THE INVENTION

Figure 1:
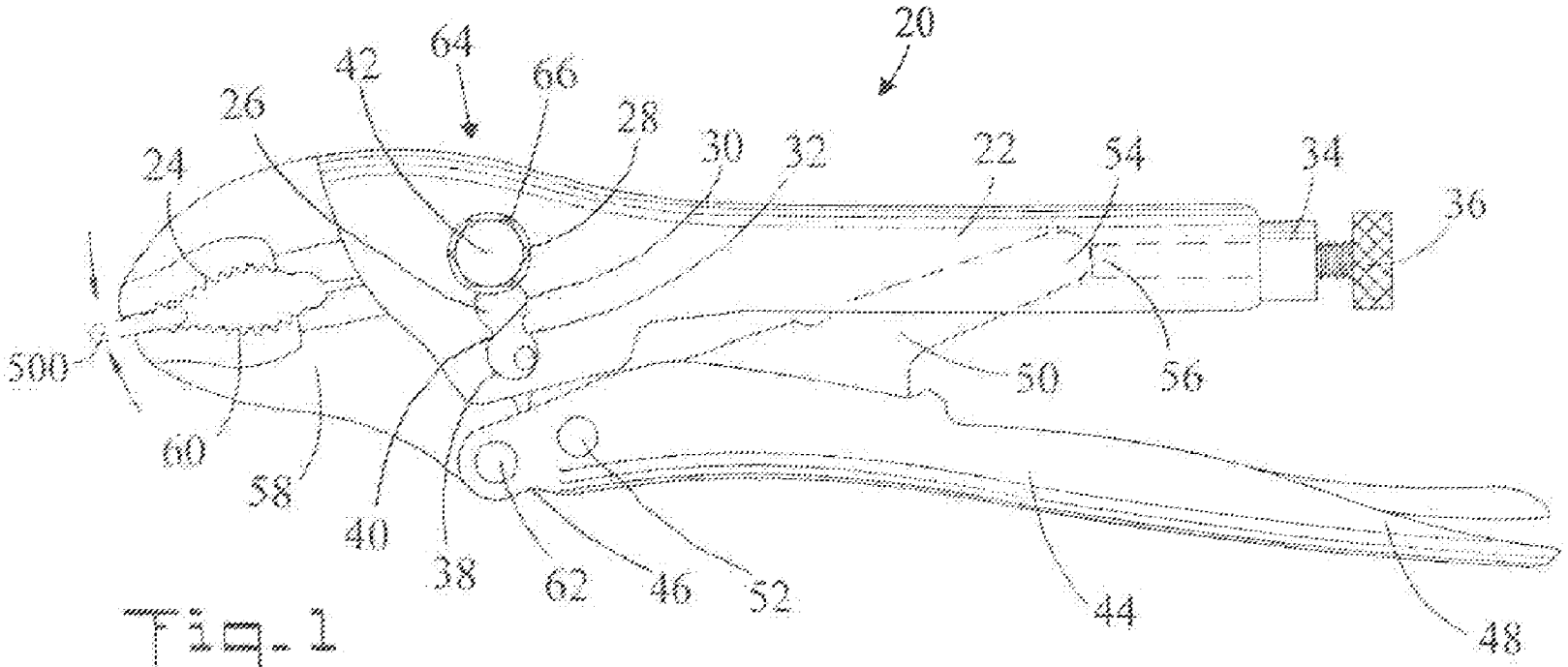
FIG. 1 is a side elevation view of a push button multi-position locking pliers in accordance with the present invention showing the jaws in a most closed position.
Figure 13:
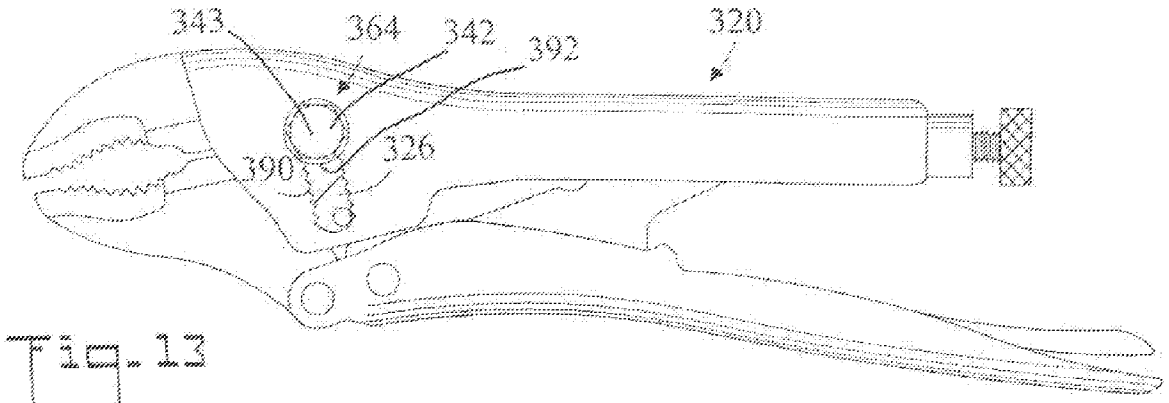
FIG. 13 is a side elevation view of the locking pliers showing a third embodiment of an adjustment slot and positioning mechanism having teeth in the slot.
Figure 14:
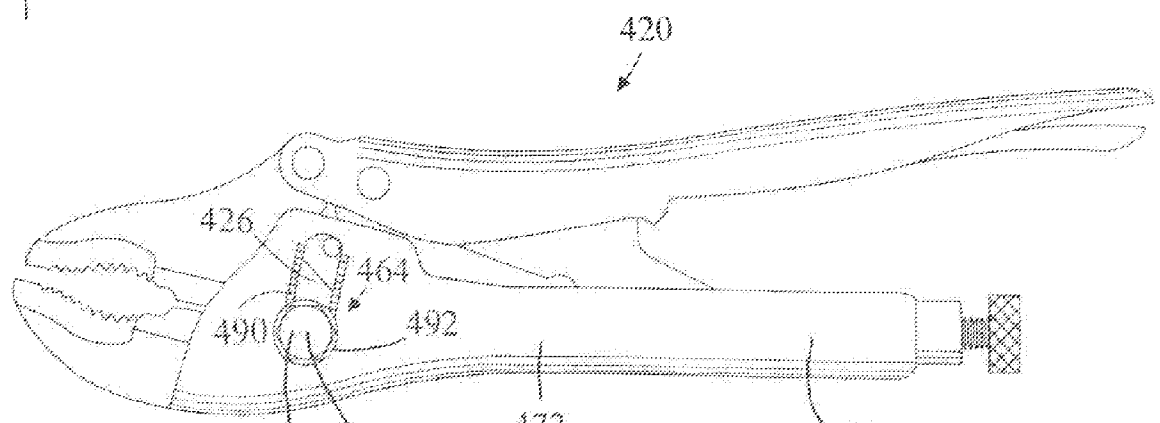
FIG. 14 is a side elevation view of the locking pliers showing a fourth embodiment of the adjustment slot and positioning mechanism having teeth on the face of the main handle.

FIG. 1 illustrates a side elevation view of a push button multi-position locking pliers for grasping an object in accordance with the present invention showing the jaws in a most closed position, the locking pliers generally designated as 20. Locking pliers 20 includes a main handle 22 having a fixed jaw 24, an adjustment slot 26 having a plurality of jaw positioning stations 28, 30, 32, and a distal end 34 spaced from the fixed jaw having an adjustment screw 36. The plurality of jaw positioning stations 28, 30, 32 includes a most closed jaw positioning station 28 shown being used in FIG. 1 and an opposite most open jaw positioning station 32 shown being used in FIG. 3. In the embodiment of the invention shown in the drawings, three jaw positioning stations 28, 30, 32 are provided, each jaw positioning station having a rounded hole 38 with a reduced portion 40 between the holes to create the slot. Other possible configurations for jaw positioning stations are shown in FIGS. 13 and 14. Three jaw positioning stations have been found to be useful because they provide a wide range of macro jaw openings in the pliers which is limited only by the width of the pliers from the top to the bottom while retaining enough of the rounded holes of the positioning stations to support the forces on the pivot 42 between the jaws.

A locking handle 44 is located below the main handle and has a jaw end 46, a distal end 48 spaced from the jaw end, and a link member 50 pivotally connected to the locking handle by a link pivot 52. The opposite end 54 of the link member 50 abuts the end 56 of the adjustment screw 36 in the main handle 22 shown by the broken lines to provide micro jaw opening adjustments in a manner well known in the over-center locking pliers art. A movable jaw member 58 having a movable jaw 60 is pivotally connected to the jaw end 46 of the locking handle 44 by a locking handle pivot 62 and has a positioning mechanism 64. The positioning mechanism 64 engages adjustment slot 26 and is selectively movable to all of the jaw positioning stations 28, 30, 32. In FIG. 1, positioning mechanism 64 has been moved to the jaw positioning station 28 that causes fixed jaw 24 and movable jaw 60 to be in a most closed position.

Figure 6:
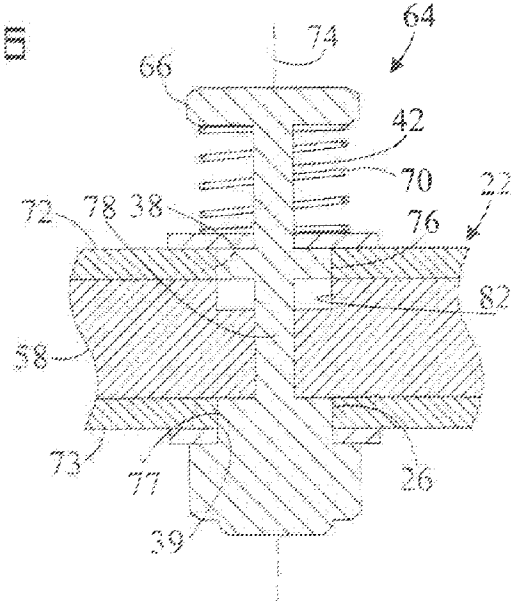
FIG. 6 is an enlarged cross sectional view along the line 6-6 of FIG. 2.
Figure 7:
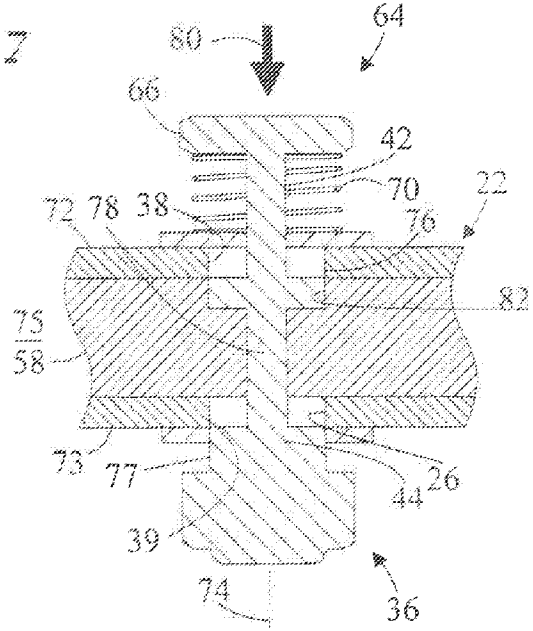
FIG. 7 is an enlarged cross sectional view similar to FIG. 6 with the push button pushed disengaging the pivot.

The positioning mechanism 64 includes the pivot 42. The pivot has a locked position as shown in FIG. 6 and a disengaged position as shown in FIG. 7. A pivot spring biases the pivot in the locked position. A push button 66 is used to push the pivot 42 out of the locked position against the pivot spring bias so the pivot can be moved to another positioning station such as stations 30 or 32. The pivot 42 positioned in the adjustment slot 26 pivotally connects the main handle 22 to the movable jaw member 58. After the pivot is moved to a new jaw positioning station, the push button is released and the pivot spring pushes the pivot back into a locked position in the new jaw positioning station.

Figure 3:
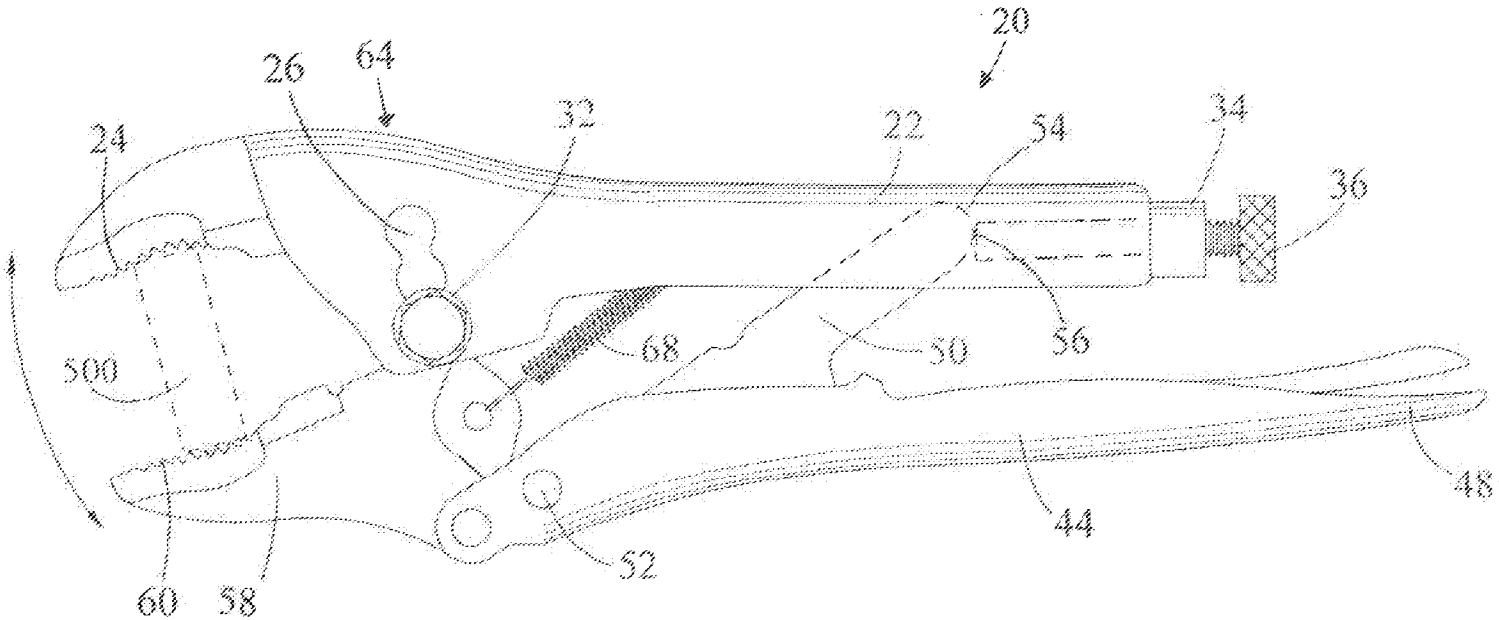
FIG. 3 is a side elevation view of the locking pliers in a most open position.
Figure 4:
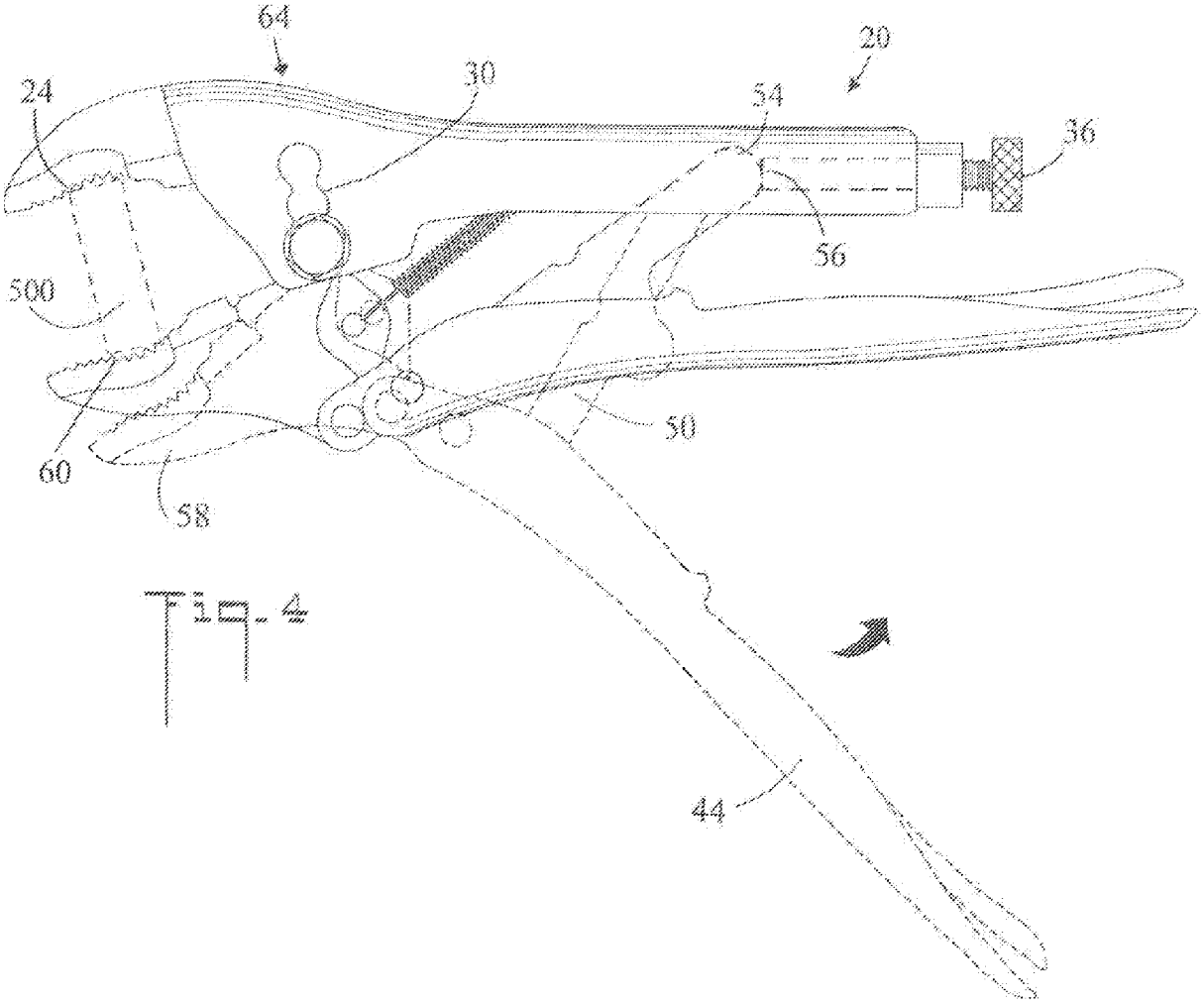
FIG. 4 is side elevation view of the locking pliers of FIG. 3 showing the conventional clamping action of the over-center mechanism.
Figure 8:
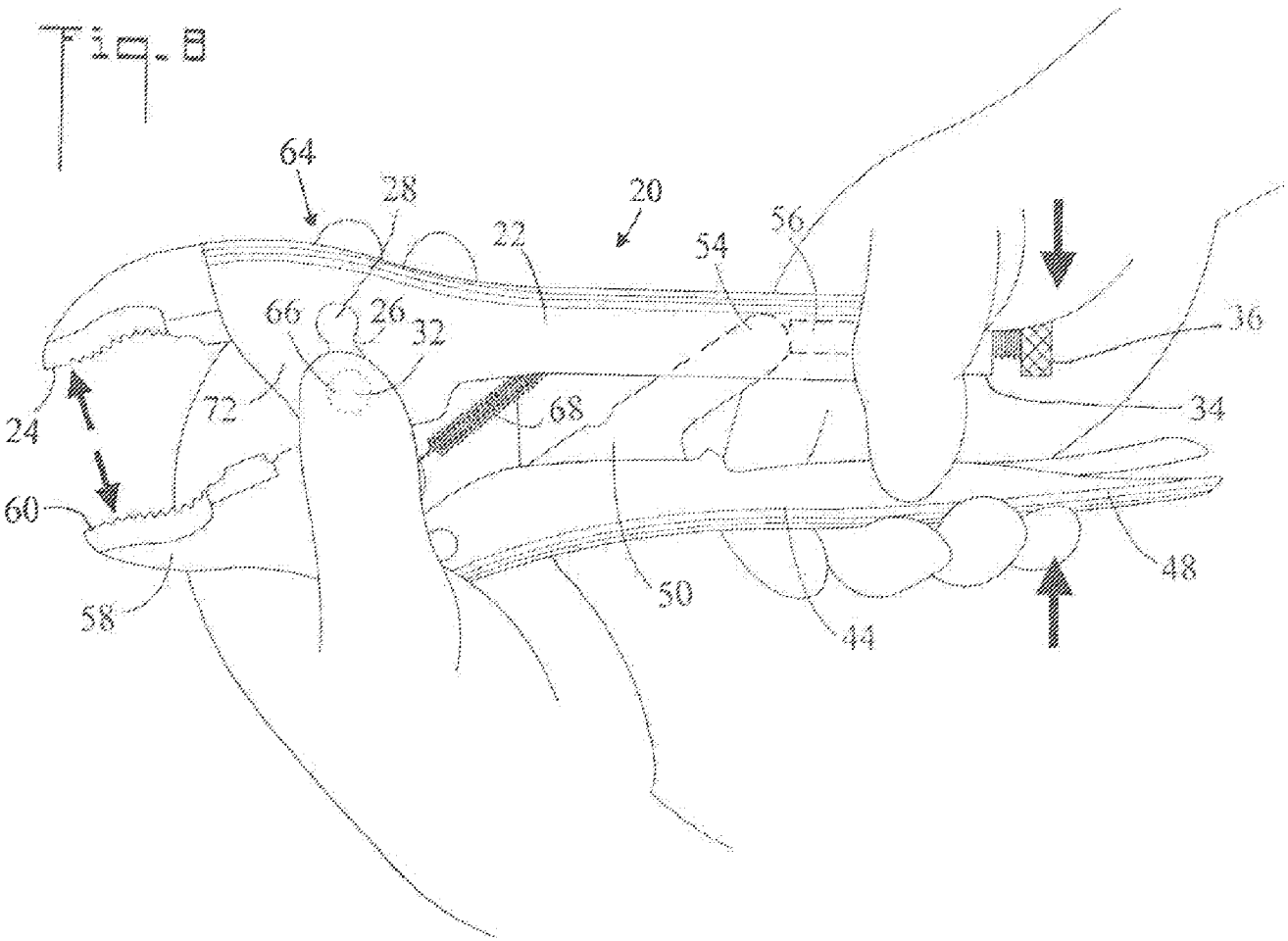
FIG. 8 is a side elevation view showing how the jaws of the locking pliers are moved from a most closed position to a most open position.

An over-center spring 68 shown in FIGS. 3, 4, and 8 is connected between the main handle 22 and the movable jaw member 58 to keep the end 54 of link member 50 pressed against the end 56 of adjustment screw 36 in a manner well know in the prior art. Main handle 22, adjustment screw 36, locking handle 44, movable jaw member 58, and over-center spring 68 comprise a conventional over-center mechanism that clamps fixed jaw 24 and movable jaw 60 on an object 500.

Figure 2:
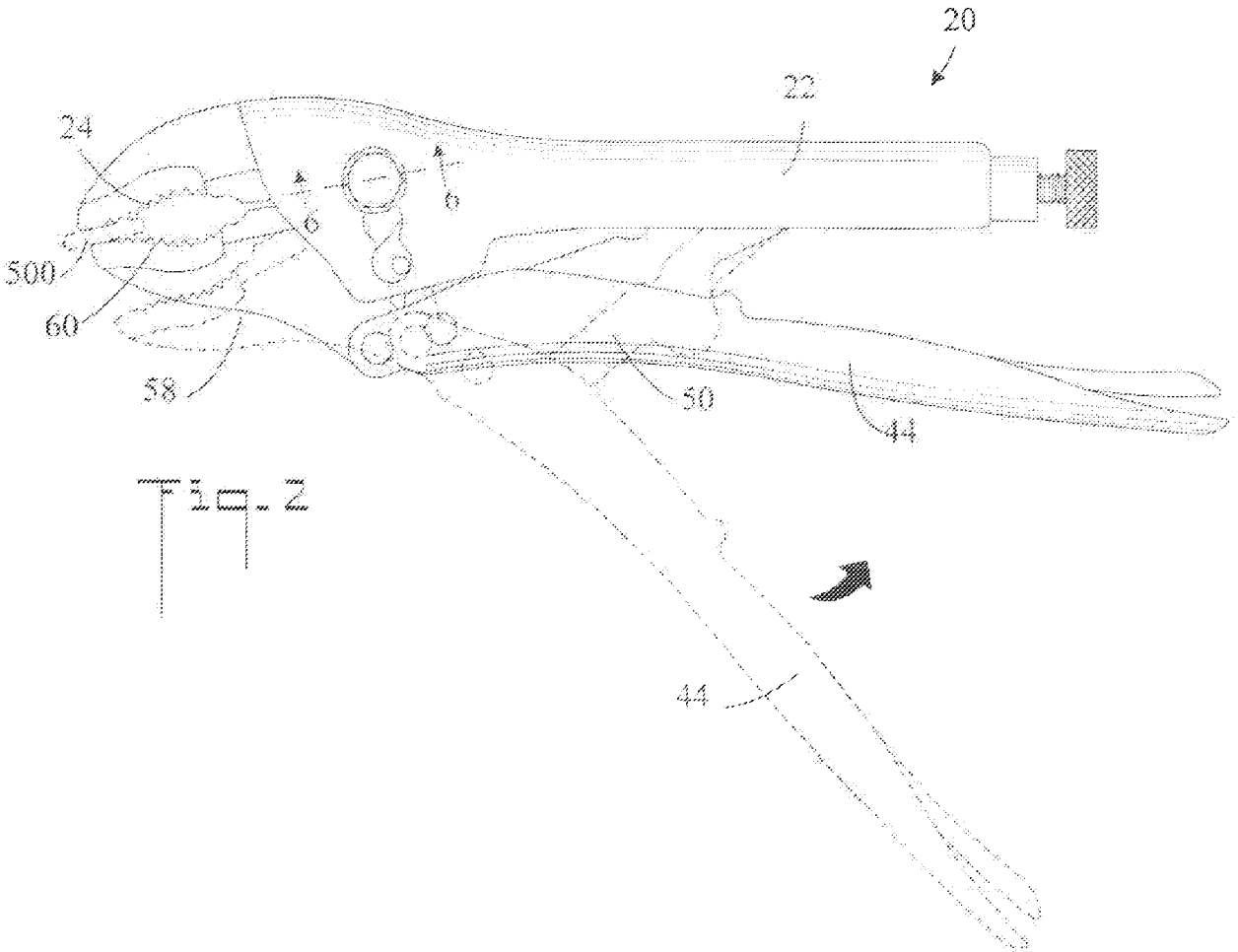
FIG. 2 is a side elevation view of the locking pliers of FIG. 1 showing the conventional clamping action of the over-center mechanism.

FIG. 2 is a side elevation view of locking pliers 20 showing the conventional clamping action of the over-center mechanism with fixed jaw 24 and movable jaw 60 on an object 500. The positions of locking handle 44, link member 50, and movable jaw member 58 prior to clamping are shown in broken lines.

FIG. 3 is a side elevation view of locking pliers 20 in the most open position. Positioning mechanism 64 has been moved to the jaw positioning station 32 at the bottom of the slot 26 that causes fixed jaw 24 and movable jaw 60 to be the furthest apart. In this position, the jaws can clamp on a larger object 500 than is possible in the position shown in FIGS. 1 and 2. Over-center spring 68 is connected between main handle 22 and movable jaw member 58 keeping the end 54 of link member 50 pressed against the end 56 of adjustment screw 36.

FIG. 4 is side elevation view of the locking pliers of FIG. 3 showing the conventional clamping action of the over-center mechanism that clamps fixed jaw 24 and movable jaw 60 on the larger object 500. The positions of locking handle 44, link member 50, and movable jaw member 58 prior to clamping are shown in broken lines. If an intermediate macro jaw width adjustment is desired, the positioning mechanism 64 is moved to the jaw positioning station 30 in the middle between the positions shown in FIGS. 1 and 3. The micro jaw width adjustment required by all over-center locking pliers to lock on any give object is provided in all three positioning stations by the end 56 of adjustment screw 36 abutting the end 54 of link member 50 in a manner well know in the art.

Figure 5:
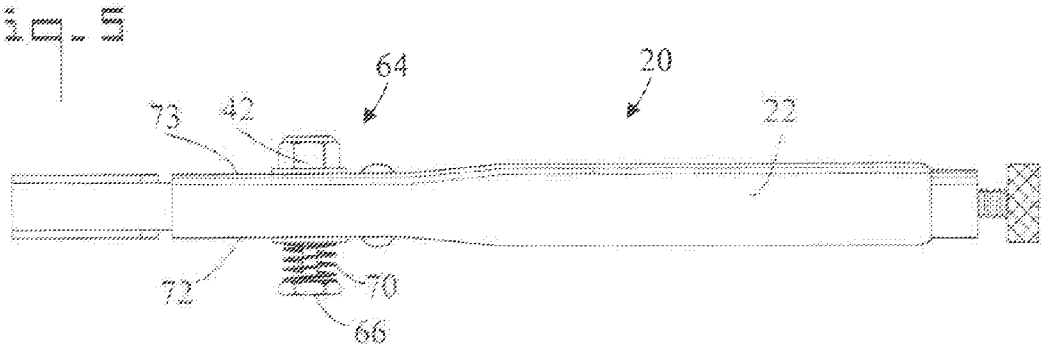
FIG. 5 is a top plan view of the locking pliers.

FIG. 5 is a top plan view of locking pliers 20 showing pivot coil spring 70 of positioning mechanism 64 biasing pivot 42 in a jaw positioning station such as positioning station 32 of FIGS. 1 and 2 by pushing the push button 66 on the end of pivot 42 away from the first side 72 of main handle 22. The positioning mechanism is disengaged by pushing push button 66 toward the first side 72 of main handle 22 against the bias of pivot spring 70.

FIG. 6 is an enlarged cross sectional view along the line 6-6 of FIG. 5. Positioning mechanism 64 includes pivot 42 that is selectively movable between a locked position shown in FIG. 6 and a disengaged position shown in FIG. 7. Pivot 42 has a longitudinal axis 74, a first rounded shoulder 76 that matches the first rounded hole 38 in first side 72 of adjustment slot 26, a second rounded shoulder 77 that matches the second rounded hole 39 in a second side 73 of adjustment slot 26, a reduced portion 78 less than the size of first and second rounded holes 38, 39, and the push button 66. The pivot spring 70 biases the pivot along the longitudinal axis 74 away from first side 72 of main handle 22 so that first rounded shoulder 76 engages first rounded hole 38 and second rounded shoulder 77 engages second rounded hole 39 of jaw positioning station 32 thereby locking pivot 42 in place (refer to FIGS. 1 and 2). Movable jaw member 58 then pivots about main handle 22 at that location.

FIG. 7 is an enlarged cross sectional view similar to FIG. 6 showing positioning mechanism 64 moved to the disengaged position. The movable jaw member 58 is positioned in the space 75 between the first and second sides 72, 73 of main handle 22. The disengaged position is achieved by pressing push button 66 on the end of pivot 42 along its longitudinal axis 74 in the direction indicated by arrow 80 toward main handle 22 against the bias of pivot spring 70. This causes first rounded shoulder 76 to move out of first rounded hole 38 of first side 72 and second rounded shoulder 77 to move out of second rounded hole 39 of second side 73 in the main handle 22 on both sides of the movable jaw member 58. The upper second rounded shoulder 77 as shown in the drawing moves above the upper second side 73 of the main handle while the lower first rounded shoulder 76 moves into a relief 82 in movable jaw member 58 thereby permitting the reduced portion 78 of pivot 42 to be moved along jaw adjustment slot 26 to another jaw positioning station.

FIG. 8 is a side elevation view showing how jaws 24 and 60 of locking pliers 20 are moved from a most closed position to a most open position at jaw positioning station 32. Starting from the most closed position of FIG. 1, a user simultaneously disengages positioning mechanism 64 by pressing push button 66 toward the first side 72 of main handle 22 (refer to FIG. 7) and manually urges the distal ends 24 and 48 of the main handle 22 and locking handle 44 together. This causes locking handle 44 to pivot on main handle 22 about where end 54 of link member 50 and end 56 of adjustment screw 36 abut. In so doing, this forces jaws 24 and 60 apart to the most open position shown against the pull of over-center spring 68. As shown in FIG. 8, locking handle 44 is at least as long as main handle 22 to allow both to be gripped simultaneously by one hand of a user so that distal ends 24 and 48 can be urged together as shown by the arrows. Also as shown in the drawing, the length of the outer portion of the locking handle 44 from the handle pivot point to distal end 48 and the length of the inner portion from the handle pivot point to the jaw end 46 (FIG. 1) are substantially the same. When the most open position is reached, push button 66 is released allowing pivot spring 70 under push button 66 to lock the pivot in the new positioning station as shown in FIG. 6.

Conversely, the most closed position of FIG. 1 may be achieved from a more open position such as shown in FIG. 8 by pressing push button 66 of pivot 42 to disengage pivot 42 as shown in FIG. 7. Over-center spring 68 then pulls movable jaw members 58 toward main handle 22 thereby placing jaws 24 and 60 in their most closed position. The narrowing can be facilitated by manually pressing the fixed jaw 24 and movable jaw 60 together.

Figure 9:
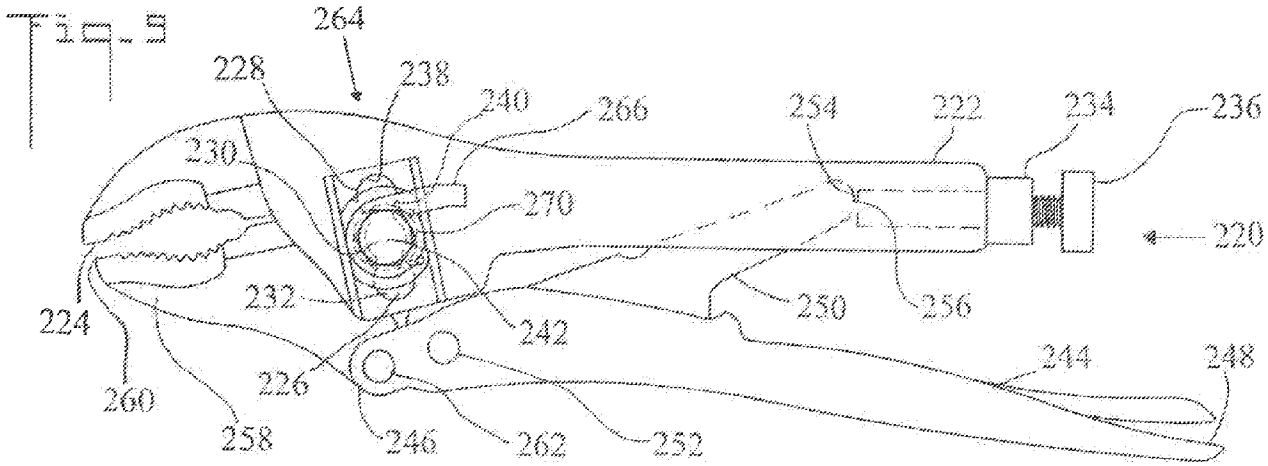
FIG. 9 is a side elevation view of the locking pliers showing a second embodiment of the adjustment slot and positioning mechanism having a rotary pivot release.

FIG. 9 is a side elevation view of the locking pliers showing a second embodiment of the adjustment slot and positioning mechanism having a rotary pivot release instead of a longitudinal pivot release, the locking pliers generally designated as 220. Locking pliers 220 includes a main handle 222 having a fixed jaw 224, an adjustment slot 226 having a plurality of jaw positioning stations 228, 230, 232, and a distal end 234 spaced from the fixed jaw having an adjustment screw 236. In the embodiment of the invention shown in the drawings, three jaw positioning stations are provided, each jaw positioning station having a rounded hole 238 with a reduced portion 240 between the holes to create the slot.

A locking handle 244 is located below the main handle and has a jaw end 246, a distal end 248 spaced from the jaw end, and a link member 250 pivotally connected to the locking handle by a link pivot 252. The opposite end 254 of the link member engages end 256 of adjustment screw 236 in the main handle to provide micro jaw opening adjustments in a manner well known in the over-center locking pliers art. A movable jaw member 258 having a movable jaw 260 is pivotally connected to the jaw end 246 of the locking handle 244 by a locking handle pivot 262 and has a positioning mechanism 264. The positioning mechanism 264 engages adjustment slot 226 and is selectively movable to all of the jaw positioning stations 228, 230, 232. In FIG. 9, positioning mechanism 264 has been moved to the middle jaw positioning station 230.

The positioning mechanism 264 includes a pivot 242 having an engaged position as shown FIG. 9 and a disengaged position when rotated 90 degrees. A pivot spring 270 biases the pivot in the engaged position. A push button 266 is used to rotate the pivot 90 degrees out of the engaged position against the pivot spring bias so the pivot can be moved to another positioning station. The pivot 242 positioned in the adjustment slot 226 pivotally connects the main handle 222 to the movable jaw member 258. After the pivot is moved to a new jaw positioning station, the push button 266 is released allowing the pivot spring 270 to push the pivot back into an engaged position in the new jaw positioning station. A guide means 290 comprised of a wall 292 on main handle 222 parallel to slot 226 and between slot 226 and the over-center spring and a washer 294 on pivot 242 having a flat side 296 that abuts wall 292 keeps pivot 242 in the middle of the slot when it is moved between jaw positioning stations 228, 230, 232. As noted above in the description of FIG. 8, the over-center spring, which is not shown in FIG. 9 but is identical to over-center spring 68 in FIGS. 3, 4, and 8, pulls movable jaw member 258 and with it pivot 242 toward main handle 222. Without guide means 290, the over-center spring would pull pivot 242 against the right side of slot 226 as shown in FIG. 9 making it difficult to align pivot 242 with a new positioning station because it would not be in the center of the slot when it reached the new positioning station. Guide means 290 facilitates the positioning of pivot 242 at a new positioning station because it always keeps pivot 242 in the middle of the slot. The remaining features of the second embodiment 220 shown in FIG. 9 are identical to those shown in FIGS. 1-4.

Figure 10:
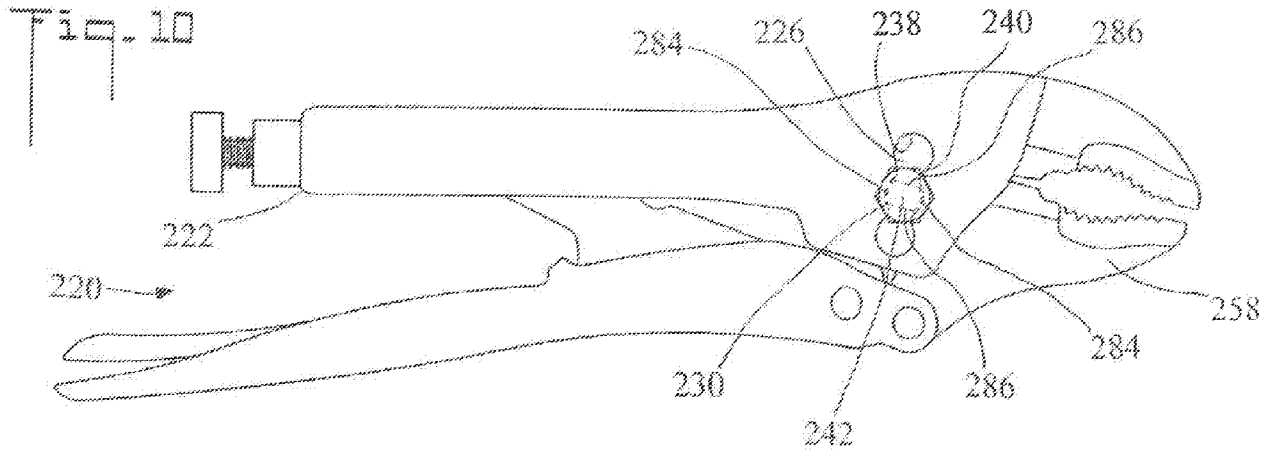
FIG. 10 is an opposite side elevation view of the embodiment of FIG. 9.

FIG. 10 is an opposite side elevation view of the second embodiment of FIG. 9 showing the features of the pivot 242 in relation to the rounded hole 238 of the middle positioning station 230 of jaw adjustment slot 226 in broken lines. Pivot 242 has two rounded shoulders 284 substantially matching the round hole 238 of positioning station 230 that provide the surfaces on which movable jaw member 258 pivots in relation to main handle 222. Pivot 242 also has two substantially parallel flats 286 along its longitudinal axis between the two rounded shoulders 284. When the push button 266 of FIG. 9 is pushed 90 degrees to rotate the pivot 90 degrees, the rounded shoulders move out of the rounded hole of positioning station 230 into the reduced portion 240 of adjustment slot 226 between the positioning stations. Pivot 242 may then be moved along adjustment slot 226 to a new positioning station by passing the flats 286 between the positioning stations. When the new positioning station is reached, the push button 266 is released allowing the pivot spring 270 to rotate the pivot back to an engaged position where the two rounded shoulders 284 of the pivot match the rounded hole 238 of the new positioning station.

Figures 11, 12:
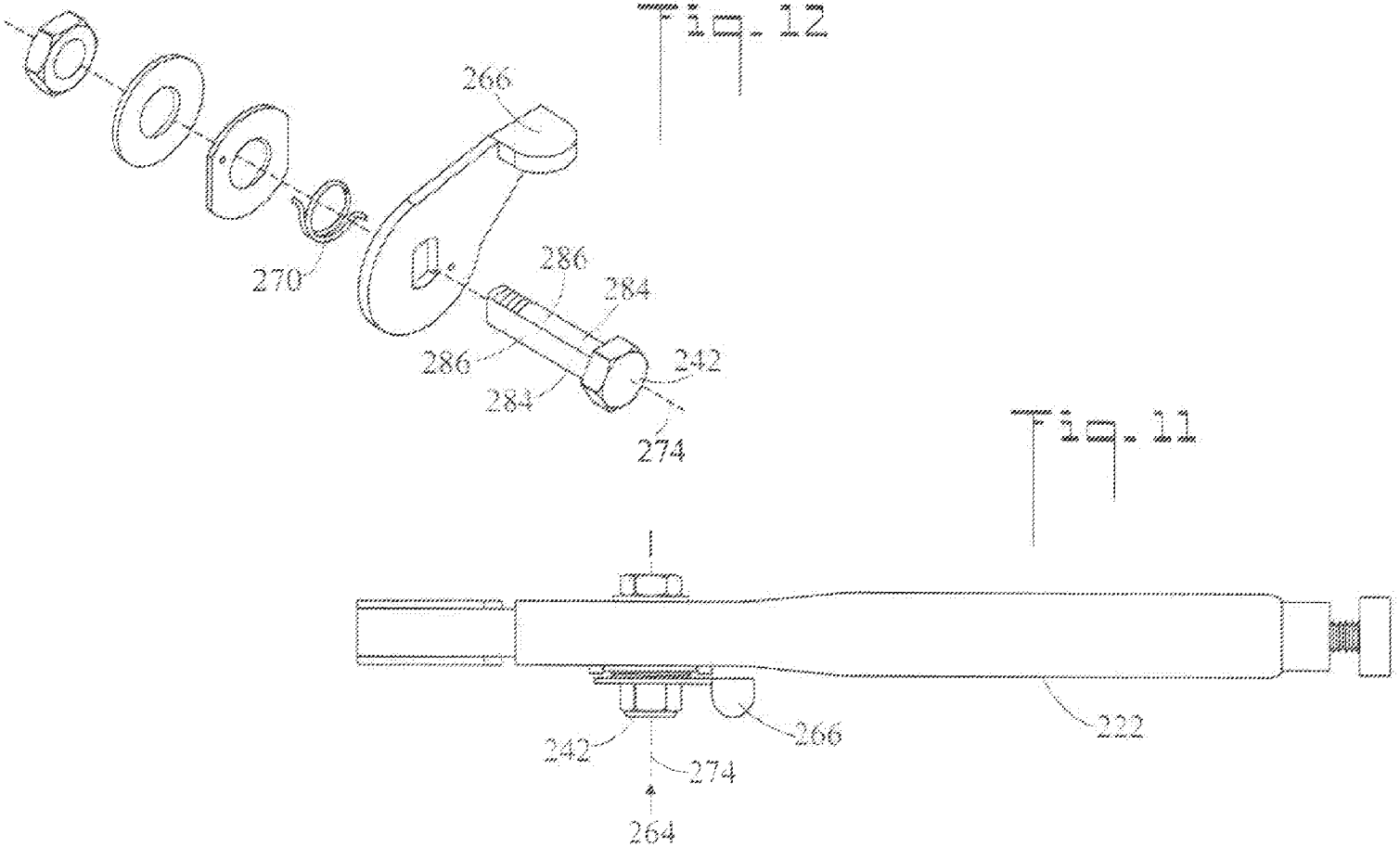
FIG. 11 is a top plan view of the embodiment of FIG. 9.
FIG. 12 is an exploded view of the positioning mechanism of the embodiment of FIG. 9.

FIG. 11 is a top plan view of the second embodiment of FIG. 9. The push button 266 is pushed down 90 degrees to rotate the pivot 242 about longitudinal axis 274 so positioning mechanism 264 may be moved in relation to main handle 222. Guide means 290 comprised of wall 292 parallel to the slot and between the slot and the over-center spring and a washer 294 on pivot 242 having a flat side 296 that abuts wall 292 keeps pivot 242 in the middle of the slot when it is moved between the jaw positioning stations.

FIG. 12 is an exploded view of the positioning mechanism of FIG. 9. Pivot 242 has two rounded shoulders 284 and two substantially parallel flats 286 along its longitudinal axis 274. When the push button 266 is pushed against the bias of pivot spring 270, pivot 242 is rotated putting the parallel flats in a position to pass between the positioning stations shown in FIGS. 9 and 10. The guide means for keeping the pivot 242 in the middle of the slot when it is moved between the jaw positioning stations includes washer 294 on pivot 242 having flat side 296 that abuts the wall to keep pivot 242 in the middle of the slot when it is moved between the jaw positioning stations.

FIG. 13 is a side elevation view of a third embodiment of the locking pliers with a different adjustment slot and positioning mechanism, generally designated 320. Both sides of adjustment slot 326 have a plurality of slot teeth 390 and the distal end 343 of pivot 342 has a plurality of pivot teeth 392 that engage the slot teeth to hold the positioning mechanism 364 and any selected jaw positioning station. All other aspects of this embodiment are the same as for the first embodiment of FIGS. 1-8 which are incorporated herein by reference. The positioning mechanism 364 is disengaged by pressing on the push button on the other side of pliers 320 to lift the pivot teeth out of the slot teeth freeing the positioning mechanism to move to a new jaw positioning station along adjustment slot 326.

FIG. 14 is a side elevation view of a fourth embodiment of the locking pliers with a different adjustment slot and positioning mechanism, generally designated 420. The side 472 of main handle 422 adjacent adjustment slot 426 has a plurality of face teeth 490 and the distal end 443 of pivot 442 has a plurality of pivot teeth 492 that engage the face teeth to hold the positioning mechanism 464 at any selected jaw positioning station. The face teeth 490 of this embodiment are perpendicular to the slot teeth 390 of the third embodiment. All other aspects of this embodiment are the same as for the first embodiment of FIGS. 1-8 which are incorporated herein by reference. The positioning mechanism 464 is disengaged by pressing on the push button on the other side of pliers 420 to lift the pivot teeth off of the face teeth freeing the positioning mechanism to move to a new jaw positioning station along adjustment slot 426.

Figure 15:
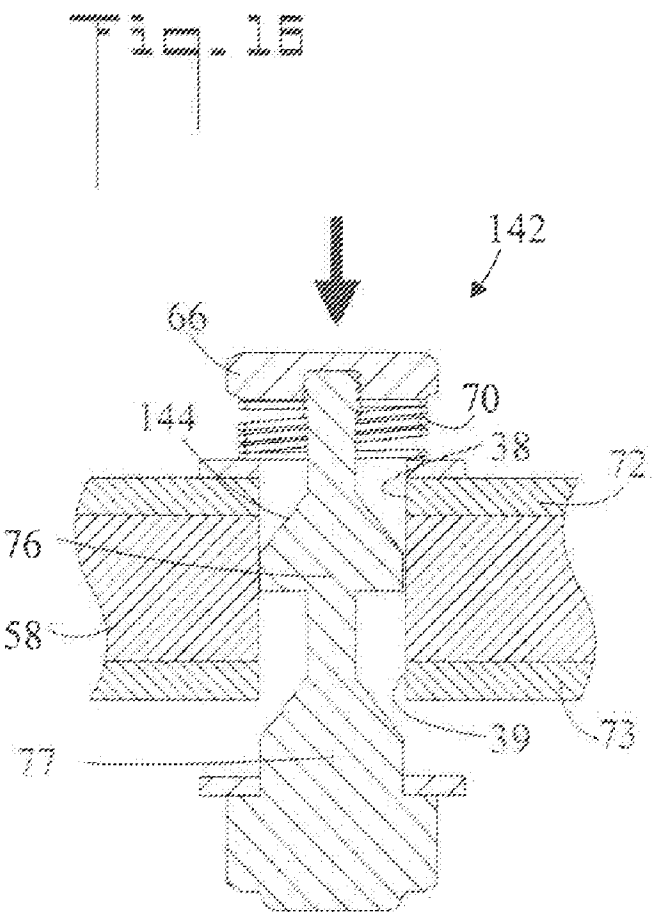
FIG. 15 is an enlarged cross sectional view as in FIG. 6 showing a second embodiment pivot in an engaged position.
Figure 15:
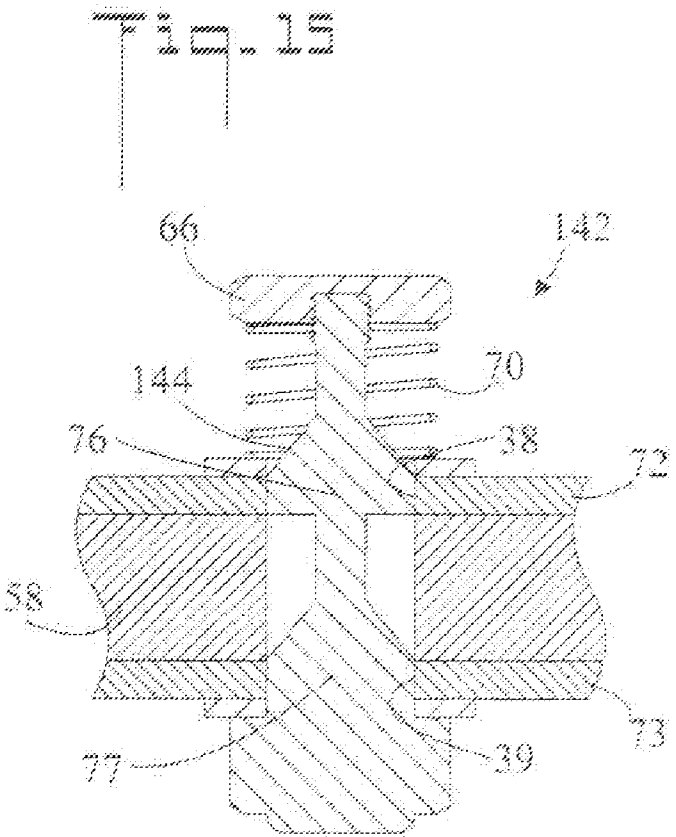

FIG. 15 is an enlarged cross sectional view as in FIG. 6 showing a second embodiment pivot in an engaged position, the second embodiment pivot generally being designated as 142. Pivot 142 includes a frustoconical section 144 which is shaped and dimensioned to engage rounded hole 38 of a jaw positioning station 28, 30, or 32 (refer to FIG. 1), so that when pivot 142 moves from the disengaged position to the engaged position frustoconical section 144 engages rounded hole 38 of jaw positioning station 28, 30, or 32 thereby urging pivot 142 to a central position within jaw positioning station 28, 30, or 32 (refer to FIG. 17 and the associated discussion). Frustoconical section 144 tapers toward the push button 66 end of pivot 142. In FIG. 15 spring 70 biases pivot 142 to the shown engaged position wherein first rounded shoulder 76 engages first rounded hole 38 of first side 72 of main handle 22 (refer to FIG. 1) and second rounded shoulder 77 engages second rounded hole 39 of second side 73 of main handle 22. That is, first rounded shoulder 76 resides within first rounded hole 38 and second rounded shoulder 77 resides within second rounded hold 39.

The problem that is solved by substituting pivot 142 for the pivot 42 of FIGS. 1-8 is that pivot 142 is self centering in the jaw positioning stations 28, 30, and 32. When it is moved from one station to another, the first and second rounded shoulders 76, 77 do not have to exactly match the walls of the jaw positioning stations 28, 30, and 32. The frustoconical sections 144, 146 will slide along the edges of the stations as drawn upward by spring 70 pushing pivot 142 into the middle of the stations until first and second rounded shoulders 76, 77 do slide into the proper positions in a station to make the pliers operable. In comparison, the pivot 42 of FIGS. 1-8 must be manually manipulated until it is jiggled into a station. In fact, this is not so easy to do. Spring 68 shown in FIGS. 3, 4, and 8 tugs movable jaw member 58 towards the back of the pliers with considerable force. This in turn tugs pivot 42 towards the back edge of the slot 26. The force and direction of the spring has been somewhat mitigated by moving the rear attachment point forward on the main handle 22 from the more common location found on most locking pliers until the longitudinal axis of the spring forms approximately a 60° angle with the longitudinal axis of the slot 26. Some of the force of the spring is thereby available to facilitate the movement of the pivot 42 up the slot. But the pivot is still pulled against the back wall of the slot and must be jiggle into a station in order for the pliers to work. The frustoconical sections 144, 146 substantially eliminate this problem by self centering on a station when pulled upward by spring 70.

FIG. 16 is an enlarged cross sectional view showing second embodiment pivot 142 in a disengaged position. Push button 66 has been pushed in the direction of the arrow against the bias of spring 70. This causes first rounded shoulder 76 and second rounded shoulder 77 to move out of contact with rounded hole 38 of first side 72 and rounded hole 39 of second side 73 of main handle 22, respectively. Movable jaw member 58 is then free to move between sides 72 and 73 of main handle 22 as has been previously described.

Figure 17:
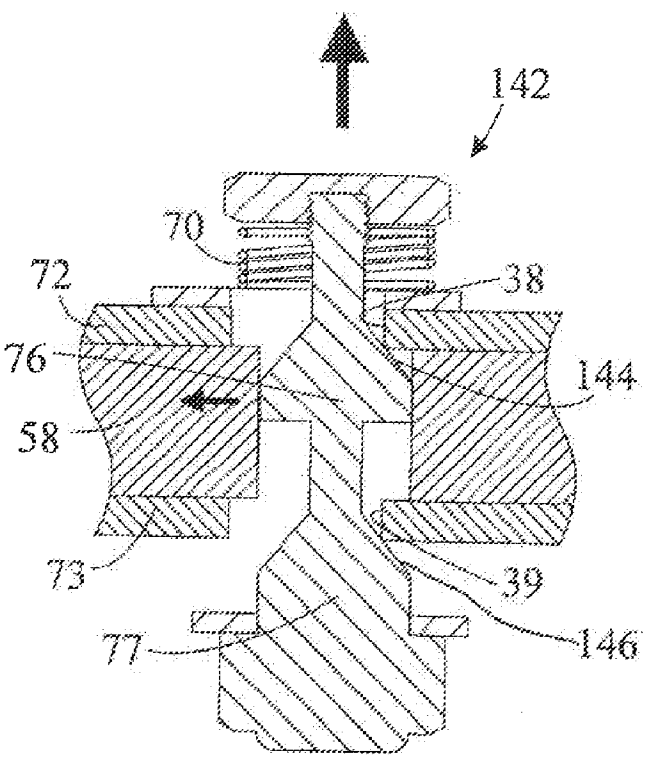
FIG. 17 is an enlarged cross sectional view showing the second embodiment pivot moving from the disengaged position to the engaged position; and, FIG. 18 is a perspective view of the second embodiment pivot.

FIG. 17 is an enlarged cross sectional view showing second embodiment pivot 142 after push button 66 is released. Expanding spring 70 is then able to push pivot 142 up as indicated by the top arrow. This causes frustoconical sections 144, 146 to bump into the sides of rounded holes 38, 39 unless it just happens that pivot 142 is perfectly aligned in the middle of the holes 38, 39 which is unlikely as noted above. As the pivot is pushed up, the frustoconical sections push the pivot as indicated by the left arrow into perfect alignment with holes 38, 39. First and second rounded shoulders 76, 77 are then in alignment with rounded holes 38 and 39. In this way, pivot 142 is self centering within jaw positioning station 28, 30, or 32 (refer to FIG. 1) so that the pliers are operable.

In the shown embodiment, second frustoconical section 146 is longitudinally spaced apart from frustoconical section 144. The spacing of frustoconical section 144 and second frustoconical section 146 is such that when frustoconical section 144 engages rounded hole 38 of jaw positioning station 28, 30, or 32 disposed on first side 72 of main handle 22, second frustoconical section 146 simultaneously engages rounded hole 39 of jaw positioning station 28, 30, or 32 disposed on second side 73 of main handle 22.

Figure 18:
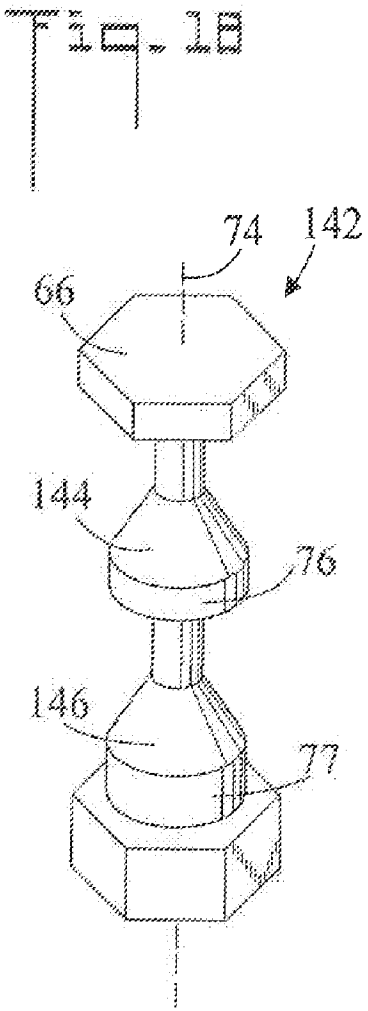

FIG. 18 is a perspective view of the second embodiment pivot 142 showing push button 66, frustoconical section 144, second frustoconical section 146, first shoulder 76, second shoulder 77, and longitudinal axis 74. It is noted that frustoconical section 144 and second frustoconical section 146 are centered about and spaced apart along longitudinal axis 74.

In terms of use, a method for placing the jaws of the locking pliers shown in a most closed position includes:

(a) providing locking pliers 20, including;

- a main handle 22 having a fixed jaw 24, an adjustment slot 26 having a plurality of jaw positioning stations 28, 30, 32, and a distal end 34 spaced from the fixed jaw having an adjustment screw 36;
- a locking handle 44 having a jaw end 46 and a distal end 48 spaced from the jaw end;
- a movable jaw member 58 pivotally coupled to the jaw end 46 of the locking handle 44 and having a movable jaw 60 and a positioning mechanism 64;
- the positioning mechanism having a pivot 42 with a disengaged position and a disengaged position, a pivot spring 70 for biasing the pivot in the engaged position, and a push button 66 for pushing the pivot out of the engaged position against the pivot spring bias;

the pivot positioned in the adjustment slot to pivotally connect the main handle to the movable jaw member and movable by pressing the push button to unlock the pivot and move the pivot to one of the plurality of jaw positioning stations and lock in the one of the plurality of jaw positioning stations upon release of the push button;

a link member 50 pivotally connected to the locking handle and engaging the adjustment screw;

an over-center spring 68 connected between the main handle and the movable jaw member;

the main handle with the fixed jaw and the adjustment screw, the locking handle, the movable jaw member with the link member, and the over-center spring comprising an over-center mechanism for locking the fixed and movable jaws on the object; and, the plurality of jaw positioning stations including a most closed jaw positioning station 28, and an opposite most open jaw positioning station 32;

(b) with positioning mechanism 64 not in most closed jaw positioning station 28, pressing push button 66 thereby disengaging positioning mechanism 64 and positioning mechanism 64 to be urged to the most closed jaw positioning station by over-center spring 68; and, (c) allowing over-center spring 68 to pull positioning mechanism 64 to the most closed jaw positioning station 28.

The method further including:

simultaneously with step (b), manually pressing fixed jaw 24 and movable jaw 60 together.

Conversely, a method for placing the jaws of locking pliers in a most open position includes:

(a) providing locking pliers 20, including;

a main handle 22 having a fixed jaw 24, an adjustment slot 26 having a plurality of jaw positioning stations 28, 30, 32, and a distal end 34 spaced from the fixed jaw having an adjustment screw 36;

a locking handle 44 having a jaw end 46 and a distal end 48 spaced from the jaw end;

a movable jaw member 58 pivotally coupled to the jaw end 46 of the locking handle 44 and having a movable jaw 60 and a positioning mechanism 64;

the positioning mechanism having a pivot 42 with an engaged position and an disengaged position, a pivot spring 70 for biasing the pivot in the engaged position, and a push button 66 for pushing the pivot out of the engaged position against the pivot spring bias;

the pivot positioned in the adjustment slot to pivotally connect the main handle to the movable jaw member and movable by pressing the push button to unlock the pivot and move the pivot to one of the plurality of jaw positioning stations and lock in the one of the plurality of jaw positioning stations upon release of the push button;

a link member 50 pivotally connected to the locking handle and engaging the adjustment screw;

an over-center spring 68 connected between the main handle and the movable jaw member;

the main handle with the fixed jaw and the adjustment screw, the locking handle, the movable jaw member with the link member, and the over-center spring comprising an over-center mechanism for locking the fixed and movable jaws on the object; and, the plurality of jaw positioning stations including a most closed jaw positioning station 28, and an opposite most open jaw positioning station 32;

(b) with positioning mechanism 64 not in the most open jaw positioning station, simultaneously pressing push button 66 thereby disengaging positioning mechanism 64, and manually urging distal ends 34 and 48 of main handle 22 and locking handle 44 together.

The possible embodiments of the locking pliers described herein are exemplary and numerous modifications, combinations, variations, and rearrangements can be readily envisioned to achieve an equivalent result, all of which are intended to be embraced within the scope of the appended claims. Further, nothing in the above-provided discussions of the locking pliers should be construed as limiting the invention to a particular embodiment or combination of embodiments. The scope of the invention is best defined by the appended claims.

I claim:

1. A push button multi-position locking pliers for grasping an object, comprising:

a main handle having a fixed jaw, an adjustment slot having a plurality of jaw positioning stations each having a rounded hole, and a distal end spaced from said fixed jaw having an adjustment screw;

a locking handle having a jaw end and a distal end spaced from said jaw end;

a movable jaw member pivotally coupled to said jaw end of said locking handle and having a movable jaw;

a pivot positioned in said movable jaw member and said adjustment slot pivotally coupling said movable jaw member to said main handle;

a link member pivotally connected to said locking handle and engaging said adjustment screw;

an over-center spring connected between said main handle and said movable jaw member biasing said link member against said adjustment screw;

a positioning mechanism for positioning said movable jaw member along said adjustment slot in one of said jaw positioning stations;

said positioning mechanism having said pivot and a pivot spring;

said pivot having an engaged position in one of said jaw positioning stations and a disengaged position not in one of said jaw positioning stations;

said pivot spring biasing said pivot in said engaged position;

said pivot having a longitudinal axis, a push button, a rounded shoulder substantially matching said rounded holes, and a frustoconical section which is shaped and dimensioned to guide said rounded shoulder into one of said rounded holes;

said pivot movable by pressing said push button along said longitudinal axis against said bias of said pivot spring to disengage said pivot from said engaged position in one of said rounded holes and move said pivot to another one of said plurality of jaw positioning stations having another of said rounded holes; and, said pivot spring pushing said pivot to center on said rounded hole upon release of said push button by said frustoconical section engaging said rounded hole when said rounded shoulder is not in alignment with said rounded hole and pushing said pivot to a self center position so that said rounded shoulder is in alignment with said rounded hole.

2. The locking pliers according to claim 1, further including:

said pivot including a second frustoconical section spaced apart from said frustoconical section.

3. The locking pliers according to claim 2, further including:

said main handle including a first side and an opposite second side; and, wherein said frustoconical section engages said rounded hole of said jaw positioning station disposed on said first side of said main handle, and said second frustoconical section simultaneously engages said rounded hole of said jaw positioning station disposed on said second side of said main handle.

4. The locking pliers according to claim 1, further including said adjustment slot having a longitudinal axis and said over-center spring positioned between said main handle and said movable jaw member at an angle of substantially 60° to the longitudinal axis of said adjustment slot.

* * * * *